US011297987B2

(12) United States Patent
Campbell-Hill

(10) Patent No.: US 11,297,987 B2
(45) Date of Patent: Apr. 12, 2022

(54) DIRT SEPARATOR

(71) Applicant: Dyson Technology Limited, Wiltshire (GB)

(72) Inventor: Alexander Michael Campbell-Hill, Wotton-Under-Edge (GB)

(73) Assignee: Dyson Technology Limited, Malmesbury (GB)

( * ) Notice: Subject to any disclaimer, the term of this patent is extended or adjusted under 35 U.S.C. 154(b) by 506 days.

(21) Appl. No.: 16/232,412

(22) Filed: Dec. 26, 2018

(65) Prior Publication Data

US 2019/0200824 A1 Jul. 4, 2019

(30) Foreign Application Priority Data

Dec. 30, 2017 (GB) ..... 1722300

(51) Int. Cl.

| | |
|---|---|
| ***A47L 9/10*** | (2006.01) |
| ***A47L 9/16*** | (2006.01) |
| ***A47L 9/20*** | (2006.01) |
| ***A47L 5/24*** | (2006.01) |

(52) U.S. Cl.

CPC ..... *A47L 9/102* (2013.01); *A47L 5/24* (2013.01); *A47L 9/165* (2013.01); *A47L 9/1608* (2013.01); *A47L 9/1666* (2013.01); *A47L 9/1683* (2013.01); *A47L 9/20* (2013.01)

(58) Field of Classification Search

None

See application file for complete search history.

(56) References Cited

U.S. PATENT DOCUMENTS

| | | | |
|---|---|---|---|
| 4,147,630 | A | 4/1979 | Laval, Jr. |
| 6,398,834 | B2 | 6/2002 | Oh |
| 6,432,154 | B2 | 8/2002 | Oh et al. |
| 6,833,015 | B2 | 12/2004 | Oh et al. |
| 6,968,596 | B2 | 11/2005 | Oh et al. |
| 7,377,953 | B2 | 5/2008 | Oh |
| 7,678,166 | B2 | 3/2010 | Yoo et al. |

(Continued)

FOREIGN PATENT DOCUMENTS

| | | | |
|---|---|---|---|
| CN | 1107482 | C | 5/2003 |
| CN | 1813622 | A | 8/2006 |

(Continued)

OTHER PUBLICATIONS

Plastic—Britannica, found at https://www.britannica.com/science/plastic (Year: 2021).*

(Continued)

*Primary Examiner* — Brian D Keller

(74) *Attorney, Agent, or Firm* — Faegre Drinker Biddle & Reath LLP

(57) ABSTRACT

A dirt separator includes a separating chamber defined by an outer wall, the separating chamber having a longitudinal axis; an air inlet into the separating chamber; and a shroud comprising a screen through which air is able to flow out of the separation chamber. The shroud further includes a shroud skirt extending about one end of the shroud, the shroud skirt being fixed to the rest of the shroud at a first, fixed edge, and having a second, free edge. The skirt shroud is formed of a deformable material and includes a plurality of ribs formed on a surface of the skirt.

19 Claims, 4 Drawing Sheets

(56) References Cited

U.S. PATENT DOCUMENTS

| | | | | |
|---|---|---|---|---|
| 7,744,668 | B2 | 6/2010 | Oh et al. | |
| 7,771,499 | B2 | 8/2010 | Oh et al. | |
| 8,978,199 | B2 | 3/2015 | Kasper et al. | |
| 2004/0025285 | A1* | 2/2004 | McCormick | A47L 9/1683 15/352 |
| 2014/0000060 | A1 | 1/2014 | Demirtas et al. | |
| 2015/0107048 | A1* | 4/2015 | Thompson | A47L 9/1666 15/353 |
| 2015/0320273 | A1 | 11/2015 | Dimbylow | |
| 2016/0287042 | A1 | 10/2016 | Han | |

FOREIGN PATENT DOCUMENTS

| | | | | |
|---|---|---|---|---|
| CN | 103025221 | A | 4/2013 | |
| CN | 103491840 | A | 1/2014 | |
| DE | 1507862 | | 12/1969 | |
| DE | 9216071 | | 1/1993 | |
| DE | 102011083449 | | 3/2013 | |
| EP | 1688184 | | 8/2006 | |
| EP | 1987759 | | 11/2008 | |
| EP | 2683283 | | 12/2014 | |
| GB | 2445211 | | 7/2008 | |
| JP | H4-2661 | Y2 | 1/1992 | |
| JP | 2002-315701 | A | 10/2002 | |
| JP | 2006-20833 | | 1/2006 | |
| JP | 2008-22914 | A | 2/2008 | |
| JP | 2013-27545 | | 2/2013 | |
| JP | 2015-519981 | A | 7/2015 | |
| KR | 10-2006-0087853 | A | 8/2006 | |
| KR | 10-0629601 | | 9/2006 | |
| KR | 10-2016-0117096 | A | 10/2016 | |
| WO | WO-2012112762 | A2 * | 8/2012 | A47L 9/1608 |
| WO | 2013/023956 | | 2/2013 | |

OTHER PUBLICATIONS

Plastic—American Heritage Dictionary, found at https://www.ahdictionary.com/word/search.html?q=plastic (Year: 2020).*

International Search Report and Written Opinion dated Mar. 27, 2019, directed to International Application No. PCT/GB2018/053141; 13 pages.

Search Report dated Jun. 21, 2018, directed to GB Application No. 1722300.9; 1 page.

Notice of Reasons for Rejection dated Dec. 16, 2019, directed to JP Application No. 2018-242698; 6 pages.

The First Office Action dated Jul. 23, 2020, directed to CN Application No. 201811601810.7; 22 pages.

Office Action received for Korean Patent Application No. 10-2020-7021381, dated May 26, 2021, 11 pages (5 pages of English Translation and 6 pages of Original Document).

* cited by examiner

DIRT SEPARATOR

REFERENCE TO RELATED APPLICATIONS

This application claims the priority of United Kingdom Application No. 1722300.9, filed Dec. 30, 2017, the entire contents of which are incorporated herein by reference.

FIELD OF THE INVENTION

The present invention relates to a dirt separator.

BACKGROUND OF THE INVENTION

In cyclonic dirt separators, a dirt collection chamber, or bin, often acts as a primary cyclonic stage where dirt is separated from the airflow flowing around the dirt collection chamber. The cleaned air then passes through a shroud. However, because air is circulating around the inside of the collection chamber, this can cause dirt that has already been separated from the airflow to be re-entrained into the airflow. To reduce the level of re-entrainment, it has become commonplace to attach a shroud skirt to the lower end of the shroud. The shroud skirt extends outwardly towards the wall of the dirt collection chamber and effectively partitions the dirt collection chamber into two sections: an upper section and a lower section. Dirt that passes into the lower section past the shroud skirt is less likely to be re-entrained into the airflow as a result of the shroud skirt.

Whilst the benefits of having a shroud skirt are apparent, they can cause problems as well. As the skirt decreases the size of the gap between the shroud and the wall of the dirt collection chamber, larger dirt and debris can become caught in the upper section of the dirt collection chamber.

Therefore there is a need for a solution that maintains the advantages of having a shroud skirt, but which alleviates some of the problems that can be caused by them.

SUMMARY OF THE INVENTION

A first aspect of the present invention provides a dirt separator comprising: a separating chamber defined by an outer wall, the separating chamber having a longitudinal axis; an air inlet into the separating chamber; and a shroud comprising a screen through which air is able to flow out of the separation chamber. The shroud further comprises a shroud skirt extending about one end of the shroud, the shroud skirt being fixed to the rest of the shroud at a first, fixed edge, and having a second, free edge. The skirt shroud is formed of a deformable material and comprises a plurality of ribs formed on a surface of the skirt.

As a result, the skirt is able to effectively reduce re-entrainment of dirt into the airflow within the dirt separator without hindering the movement of any large dirt or debris past the shroud skirt. The shroud skirt is able to deform into a position where there is no decrease in the size of the gap between the shroud and the outer wall at the shroud skirt. The ribs encourage the shroud skirt to return to a non-deformed position, and make the skirt more robust and resilient to damage during any periods in which it is being deformed.

The plurality of ribs may be evenly spaced around the circumference of the shroud skirt. The shroud skirt is therefore uniformly supported around its entire circumference, which helps to reduce the possibility of any weak points being formed in the shroud skirt. The evenly spaced ribs also evenly encourage the whole shroud skirt into the non-deformed position, meaning that an effective reduction of re-entrainment of dirt around the whole separating chamber is achieved.

The ribs may extend from the first fixed edge and extend partially along a surface of the skirt towards the free edge. The ribs may extend between 50% and 100% of the distance from the fixed edge to the free edge. The ribs therefore provide strength and support to the shroud skirt close to the joint where the shroud skirt is fixed to the rest of the shroud. This strengthens the shroud skirt where the most force is experienced when there is deformation, and helps to avoid any damage or ripping occurring. If the ribs do not as far as the free edge, the shroud skirt is able to deform more easily at the free edge, making it easier for larger bits of dirt and debris to deform the shroud skirt in order to pass around it.

The shroud skirt may be pleated and each pleat may be positioned between two consecutive ribs. By pleating the shroud skirt, this encourages the skirt to adopt a uniform concertina when it is deformed which helps to reduce the possibility of pinch points being created which could permanently deform the shroud skirt, or cause other damage to the shroud skirt.

The ribs may be formed on the surface of the shroud skirt that is closest the screen. As a result, the ribs provide more a stronger biasing force to the shroud skirt in one direction than the other, and it is easier to deform the shroud skirt away from the shroud screen than towards it. It would be undesirable for the shroud skirt to be deformed towards the shroud screen while the dirt separator is in use, as it would effectively block a portion of the screen and reduce the performance of the dirt separator.

In an unbiased position the shroud skirt may be angled towards the outer wall and extends away from the longitudinal into the separating chamber. As a result, the shroud skirt is more effective at preventing dirt from being re-entrained in the airflow in the dirt separator.

The shroud skirt may be deformable into a first deformed position in which the shroud skirt is collapsed towards the longitudinal axis of the separating chamber away from the shroud screen. The free edge of the shroud skirt may concertina when in the first deformed position. As a result, the shroud skirt can align itself to extend in a direction that is parallel to the longitudinal axis. In this position, the shroud skirt can have an outer diameter that is the same as the shroud screen.

The shroud skirt may be deformable between the first deformed position and a second deformed position in which, the shroud skirt is collapsed in an opposite direction to that of the first deformed position, and lies against the shroud screen. Accordingly, the shroud skirt can be folded out of the way of components of the dirt separator, or dirt itself, which may need to pass around the shroud skirt.

The ribs may be formed as an increased thickness of shroud skirt material in localised areas where ribs are required. As a result, separate rib portions to not need to be attached to the shroud skirt material, as they are formed into the material of the shroud skirt itself. This reduces the assembly cost of the dirt separator, and also reduces the possibility that a rib could become detached from the shroud skirt, The dirt separator may further comprise a wiping mechanism for wiping the shroud during a dirt emptying operation. The wiping mechanism may comprise a wiper that contacts the screen and during the dirt emptying operation slides along the length of the screen in a longitudinal direction to push dirt towards an opening in the separating chamber. As a result, an improved dirt emptying operation is achieved which ensures that any dirt caught around the shroud screen is wiped away and expelled from the dirt separator.

During the emptying operation, the wiper may contact the shroud skirt and deform it into the first deformed position defined in the earlier statement. By collapsing the shroud skirt during the emptying operation, larger dirt particles which would otherwise have been trapped by the shroud skirt are able to pass the shroud, and be expelled from the dirt separator.

On contacting the shroud skirt, the wiper may first contact the ribs on the skirt which initiates a concertina deformation in the shroud skirt. As a result, the concertina action prevents any pinch points in the shroud skirt as it is collapses from the force applied to it by the wiper. Pinch points could cause the shroud skirt to be permanently deformed, or could result in the shroud skirt being damaged.

The outer wall of the separating chamber may be slidable relative to the shroud, and the outer wall may comprise the wiper which extends radially inwards from the outer wall. As a result, the action of sliding the separating chamber relative to the shroud also acts to wiper the dirt off the shroud screen without requiring a separate wiping mechanism, and this therefore provides a simple and cheap solution.

The outer wall may be removable from the dirt separator, and during removal of the outer wall the wiper slides over the shroud skirt while it is in the first deformed position defined in earlier statements. During reassembly of the outer wall onto the dirt separator, the wiper may deform the shroud skirt into the second deformed position defined in earlier statements. Accordingly, the outer wall can be easily removed from and reassembled onto the dirt separator if more thorough cleaning of the dirt separator is required. In addition, because the wiper slides over the deformed shroud skirt, the outer wall can be removed and reassembled without requiring any components of the dirt separator to be dismantled.

The shroud skirt may be formed of moulded rubber.

The present invention further provides a vacuum cleaner comprising the dirt separator as in any one of the previous statements.

BRIEF DESCRIPTION OF THE DRAWINGS

In order that the present invention may be more readily understood, embodiments of the invention will now be described, by way of example, with reference to the following accompanying drawings, in which.

DETAILED DESCRIPTION OF THE INVENTION

Figure 1:
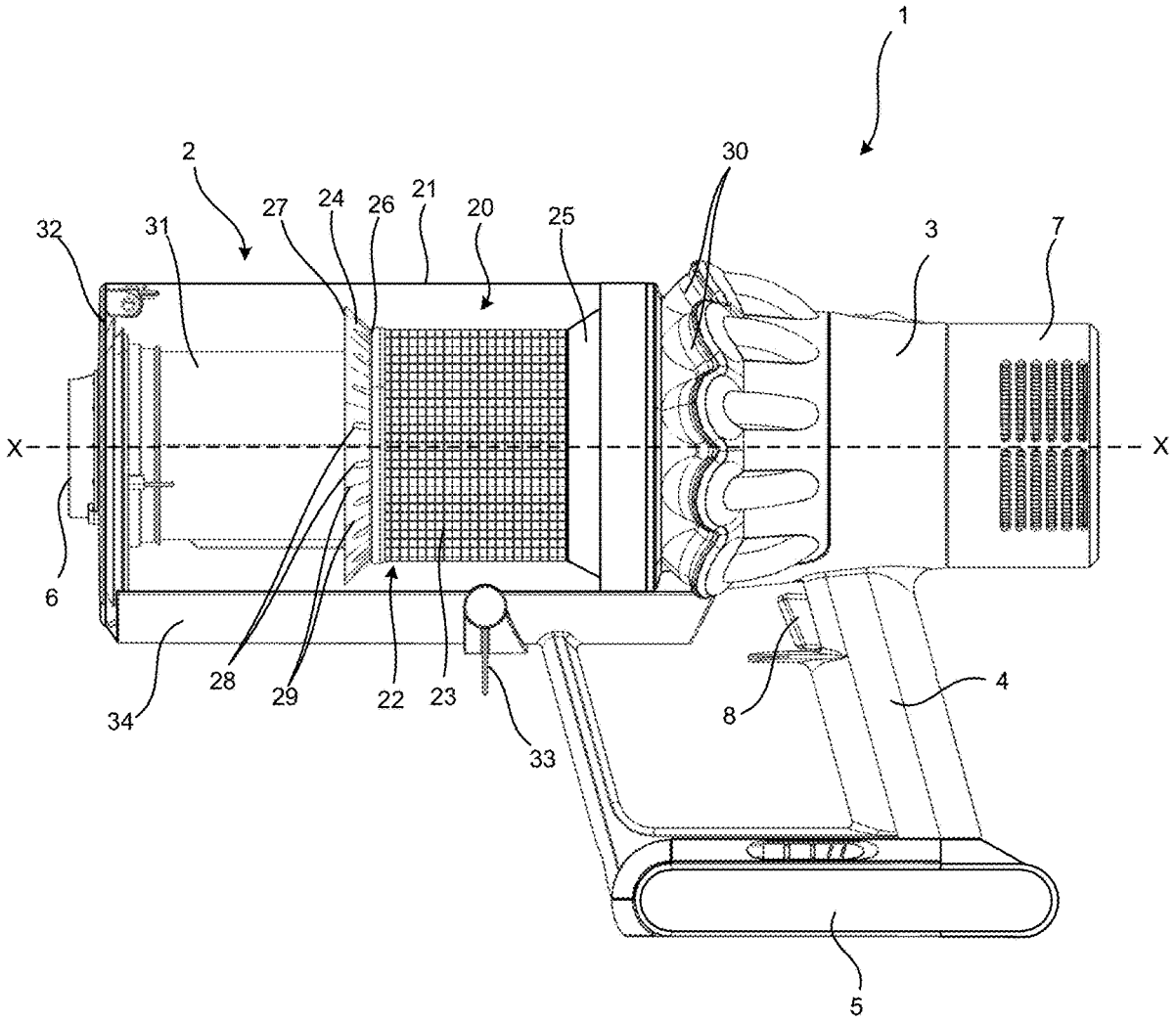
FIG. 1 shows a vacuum cleaner.

FIG. 1 shows a vacuum cleaner 1 having a dirt separator 2, a main body 3, a handle 4, a power source in the form of battery pack 5, and an inlet 6. At the rear of the vacuum cleaner 1, attached to the main body 3, is a filter assembly 7.

The dirt separator 2 has a primary cyclonic stage comprising a separating chamber 20 which is defined by a cylindrical outer wall 21. The separating chamber 20 is sometimes referred to as a bin, and it has a longitudinal axis, indicated by the dotted line X. Inside the separating chamber 20 is a shroud 22 which comprises a cylindrical screen 23 and a shroud skirt 24. A wiper 25 is fixed to the outer wall 21 of the separating chamber 20. The wiper 25 extends inwards from the outer wall 21 and contacts the screen 23.

The shroud skirt 24 is formed of a moulded rubber material, and is fixed to an end of the shroud screen 23 along a fixed edge 26. The shroud skirt 24 is shown in FIG. 1 extending at an angle outwards towards the outer wall 21 such that a free edge 27 of the shroud skirt 24 is closer to the outer wall 21 than the fixed edge 26. A plurality of ribs 28 are formed on a top surface of the shroud skirt 24. The ribs 28 are formed from the same material of the shroud skirt 24, and are areas of increased thickness of the skirt material. The plurality of ribs 28 are evenly spaced around the circumference of the shroud skirt 24. The ribs extend from the fixed edge 26, and they end at around 75% of the distance to the free edge 27. It is preferable if the ribs extend between 50% and 100% of the distance between the fixed edge 26 and the free edge 27. The shroud skirt 24 is also slightly pleated, with pleats 29 (sometimes referred to as creases or folds) being positioned between the ribs 28, such that pleats and ribs alternate around the circumference of the shroud skirt 24.

Due to the reduced size of the gap between the outer wall 21 and the shroud skirt 24, the shroud skirt 24 acts to effectively separate the separating chamber into two portions—a separation portion around the shroud around which airflow can swirl, and a dirt collection portion below the shroud where dirt separated in the separation chamber 20 can collect prior to being emptied.

A secondary cyclonic stage comprises a plurality of small cyclone bodies 30 and a fine dust collection chamber 31 which extends through the separating chamber 20. During operation of the vacuum cleaner 1, when the trigger 8 is pulled a motor (not shown), which is housed inside the main body 3 and powered by the battery pack 5, generates an airflow through the vacuum cleaner 1. Dirt-laden air is drawn into the vacuum cleaner 1 through the inlet 6. The dirt-laden air enters the dirt separator 2 at an air inlet into the separating chamber (not shown) and swirls around the separating chamber 20. Larger dirt and debris is removed from the air due to centrifugal forces as the air swirls around separating chamber 20. After the larger dirt and debris has been separated from the airflow in the separating chamber 20, the air passes through the shroud 22 and enters the secondary cyclonic stage. The small cyclone bodies 30 are able to separate any of the finer dust that was about to pass through the shroud, and the fine dust passes into the fine dust collection chamber 31. The clean air leaving the secondary cyclonic stage then passes through the motor and filter assembly 7 before being expelled into the atmosphere.

The separating chamber 20 and the fine dust collection chamber 31 are open at one end, and are closed by way of a lid 32 that is hingedly fixed to the outer wall 21. The lid 32 is pivotable between a closed position in which the separating chamber 20 and the fine dust collection chamber 31 are sealed to contain any dirt and dust inside them, and an open position in which the ends of the separating chamber 20 and the fine dust collection chamber 31 are open, and dirt and dust can be removed or ejected. A central portion of the lid 32 comprises a hole through which the inlet 6 protrudes.

Figure 2A:
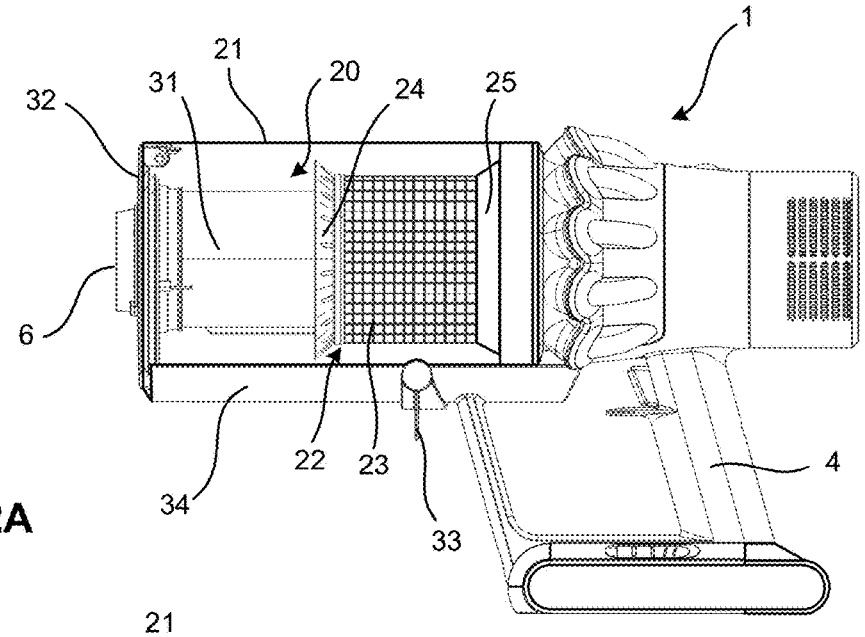
FIGS. 2A, 2B and 2C show the vacuum cleaner of FIG. 1 at different stages during a dirt emptying procedure.
Figure 2B:
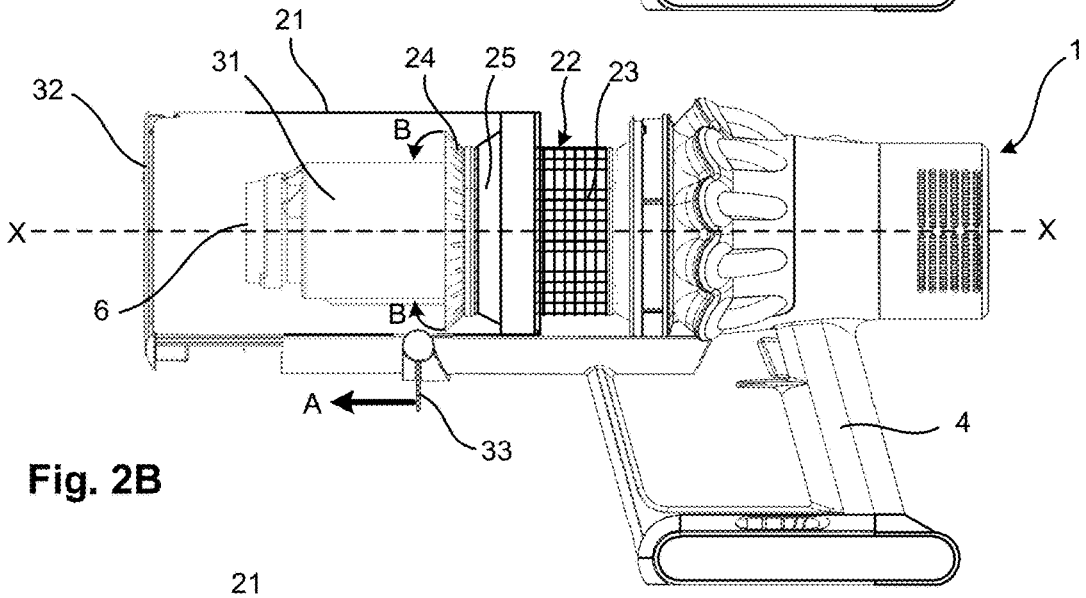
Figure 2C:
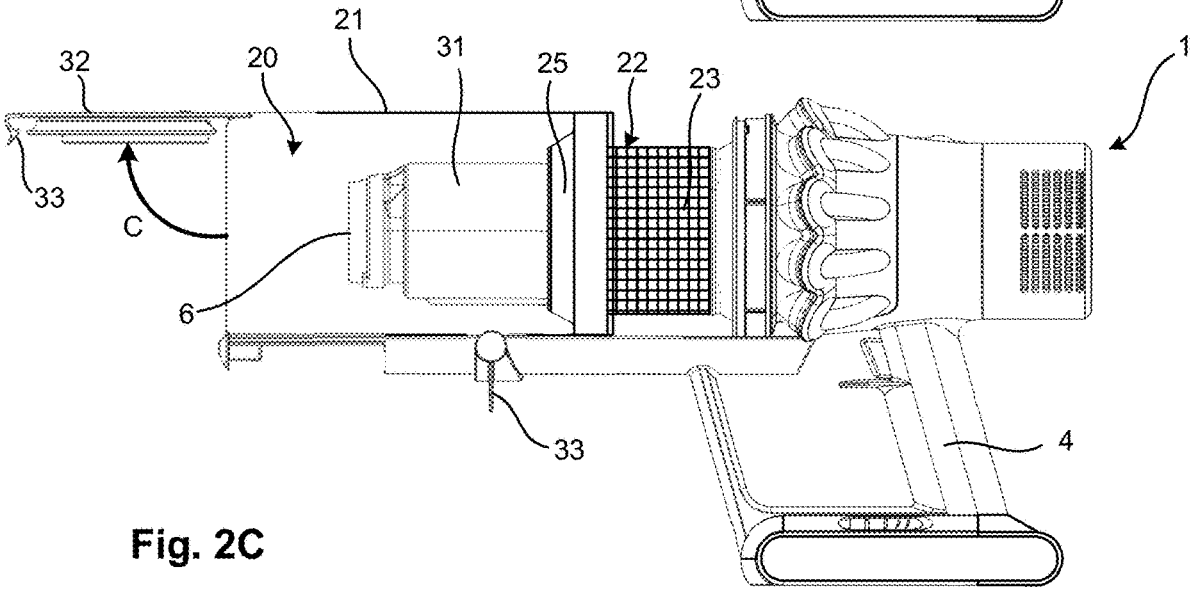

FIGS. 2A, 2B, and 2C show the vacuum cleaner 1 at different stages during a dirt emptying procedure. The dirt separator 2 is provided with a bin opening actuator 33. When the bin opening actuator 33 is pushed away from the handle 4 in a direction shown by arrow A, this causes the outer wall 21 and the lid 32 of the separating chamber 20 to slide along the runner portion 34 of the vacuum cleaner 1 in the same direction. The shroud 22 and the fine dirt collection chamber 31 remain stationary. As the outer wall 21 and lid 32 move, the open end of the fine dirt collection chamber 31 is revealed. In addition, the wiper 25 which is attached to the outer wall 21 acts to wipe the cylindrical surface of the shroud screen 23 as the wiper 25 moves with the outer wall 21, removing any dirt and dust that is caught on the surface of the screen.

When the wiper 25 reaches the end of the screen 23, it contacts the shroud skirt 24 and causes it to collapse inwards towards the longitudinal axis X of the separating chamber, as shown by the arrows B in FIG. 2B, such that there is no longer a decrease in size of the gap between the shroud skirt 24 and the outer wall 21 compared to the size of the gap between the screen 23 and the outer wall 21. This allows the wiper 25 to pass over the shroud skirt 24 in the same way that it has passed over the screen 23, as shown in FIG. 2C, which ensures that any dirt or dust that may have been trapped in the upper portion of the separating chamber 20 around the shroud is pushed into the lower portion of the separating chamber 20 so that it can be more easily ejected.

As shown in FIG. 2C, once the outer wall 21 has reached a certain point in the direction away from the handle, it stops and a catch 33 holding the lid 32 closed is released. The lid 32 is hinged and comprises a biasing member in the hinge which biases the lid 32 into an open position. Accordingly, as soon as the catch 33 is released, the lid 32 pivots around the hinge, and swings open as indicated by arrow C. Dirt collected within the first and second dirt collection chambers can now be ejected from the dirt separator.

The ribs 28 are formed on the upper surface of the shroud skirt 24, the upper surface (also referred to as the top surface) is the surface facing, or closest to, the shroud screen 23. An underneath surface of the shroud skirt 24 is the surface facing the openable end of the separating chamber 20. The ribs 28 make the shroud skirt 24 more robust and resilient to damage. Furthermore, with the ribs 28 being positioned on the upper surface, they are the first part of the shroud skirt 24 to come into contact with the wiper 25 as it reaches the end of the screen 23. This causes the portions of the shroud skirt 24 where the ribs 28 are located to deform first, and the free edge 27 starts to concertina as the shroud skirt 24 collapses. The pleats 29 further assist the skirt to concertina in this way. A pleat may alternatively be referred to as a fold or crease.

Figure 3A:
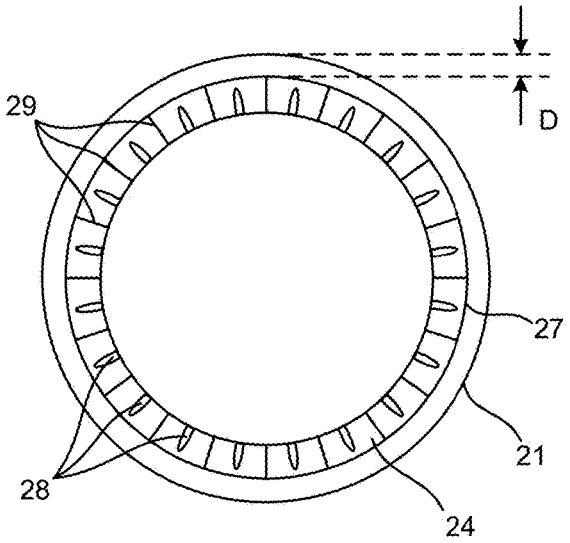
FIG. 3A shows a top view of a shroud skirt in an unbiased position.
Figure 3B:
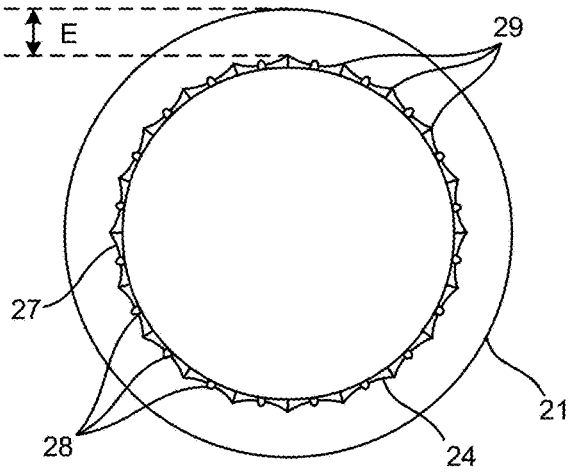
FIG. 3B shows a top view of the shroud skirt of FIG. 3A in a biased position.
Figure 4A:
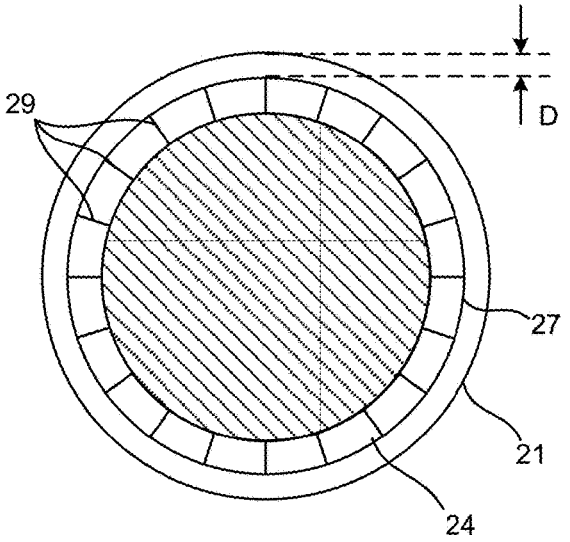
FIG. 4A shows an underneath view of the shroud skirt of FIG. 3A in the unbiased position.
Figure 4B:
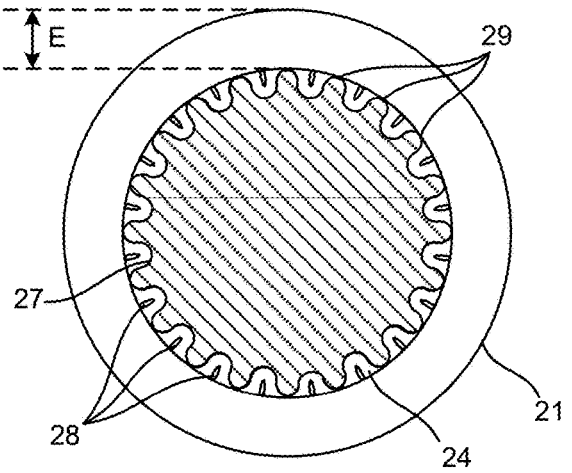
FIG. 4B shows an underneath view of the shroud skirt of FIG. 3A in a biased position.

FIGS. 3A and 3B show the shroud skirt 24 from above in a cross section through the separating chamber 20, where the skirt is in an unbiased position in FIG. 3A and a biased position in FIG. 3B. FIGS. 4A and 4B show underneath views of the shroud skirt in corresponding unbiased and biased positions. The biased position shown in FIGS. 3B and 4B correspond to the position that the shroud skirt 24 takes in FIG. 2C when the wiper 25 has forced the shroud skirt 24 into a collapsed position. When the shroud skirt 24 is in the unbiased position, as shown in FIGS. 3A and 4A, the distance D between the free edge of the skirt and the outer wall 21 is smaller than the distance E between the outer wall 21 and the shroud skirt 24 in FIGS. 3*b* and 4B. This allows dirt to pass around the shroud skirt 24 without being hindered by a restriction.

Closing the separating chamber 20 and the fine dust collection chamber 31 comprises sliding the outer wall 21 back to its original position, and pivoting the lid 32 into a closed position where the catch 33 engages again to hold the lid 32 in the closed position. When the wiper 25 slides off the shroud skirt 24 and back into contact with the shroud screen 23, the shroud skirt 24 is free to return to its non-biased position. The ribs 28 act to encourage the shroud skirt 24 back into the non-biased position.

Figure 5A:
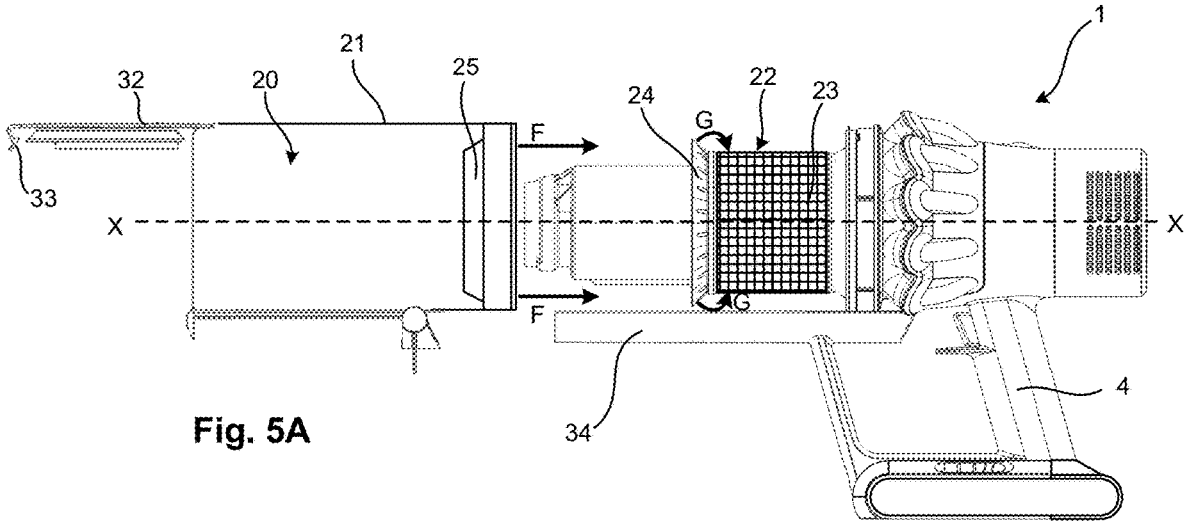
FIGS. 5A, 5B and 5C show the vacuum cleaner of FIG. 1 at different stages during a procedure to reattach a bin.
Figure 5B:
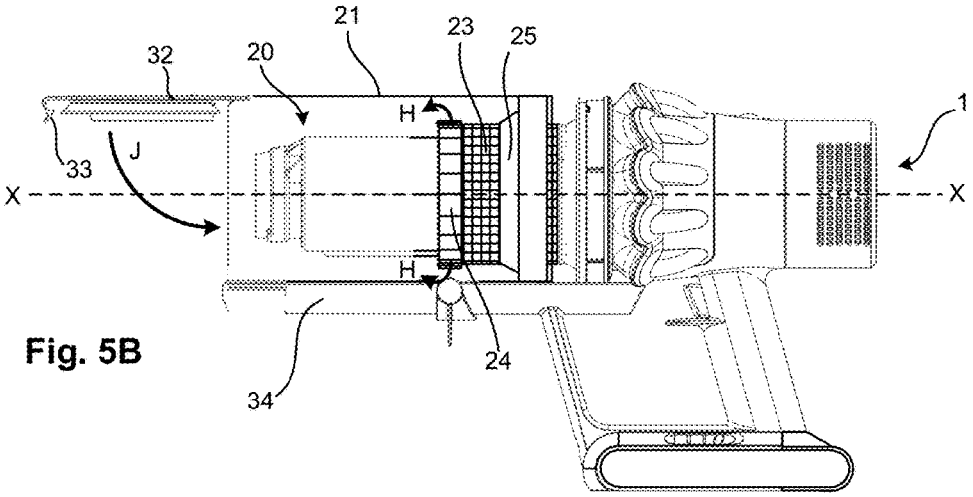
Figure 5C:
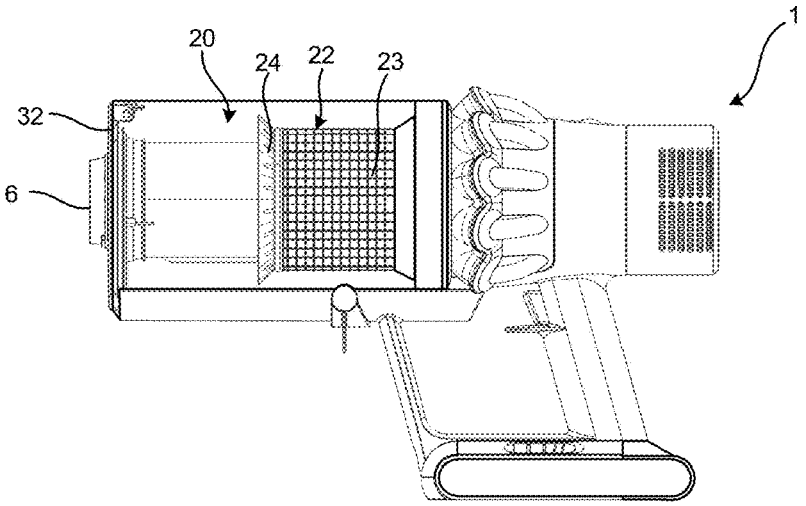

In order to carry out a thorough emptying or cleaning of the separating chamber 20, the outer wall 21, lid 32 and wiper 25 may be removed completely from the vacuum cleaner 1. When the outer wall 21 is at the extended position shown in FIG. 2C, a release catch (not shown) is visible that can be actuated by a user to allow the outer wall 21 to be removed. FIGS. 5A, 5B and 5C show the vacuum cleaner during the operation to replace the bin after it has been removed. When the outer wall 21 is separated from the vacuum cleaner 1, there is no wiper 25 to apply a force to the shroud skirt 24 and it adopts the unbiased position shown, for example, in FIG. 1 in which it is angled outwards away from the longitudinal axis X of the separating chamber 20. The outer wall 21 is slidably received onto the runner 34 in the direction indicated by arrows F in FIG. 5A. When the wiper 25 contacts the shroud skirt 24, it forces the skirt 24 to be deflected upwards in the direction of the arrows labelled G, and it flattens it against the screen 23 of the shroud 22 in order that the wiper 25 can pass over the shroud skirt 24.

Once the wiper has passed the shroud skirt 24, and is once again in contact with the shroud screen 23 as shown in FIG. 5B, there is nothing biasing the shroud skirt 24 into the position in which it is flat against the screen 23, and so the shroud skirt 24 returns to the unbiased position as indicated by the arrows H. By forming the ribs 28 on the upper surface of the shroud skirt 24, the ribs 28 encourage the shroud skirt 24 to return to the unbiased position with a greater return force due to the ribs 28 pressing against the screen 23. To close the open ends of the separating chamber 20 and the fine dust collection chamber 31, the lid 32 can be pivoted in the direction of arrow J into a closed position in which the catch 33 engages again to hold the lid 32 in the closed position. The vacuum cleaner 1 is then once again in an operational state, with the separating chamber 20 in its original position, the lid 32 closed such that dirt can be collected in the separating chamber 20 and the fine dust collection chamber 31, and the inlet extending through the hole in the lid 32.

Whilst particular embodiments have thus far been described, it will be understood that various modifications may be made without departing from the scope of the invention as defined by the claims.

For example, in the embodiments described above, the ribs are formed on the upper surface of the shroud skirt, however in alternative embodiments the ribs may be positioned on the underneath surface of the skirt. In addition, the in the embodiments described above, the ribs are moulded as part of the skirt material, however in alternative embodiments the ribs may be separate entities that are fixed or bonded onto the shroud skirt.

The invention claimed is:

1. A dirt separator comprising:

a separating chamber defined by an outer wall, the separating chamber having a longitudinal axis;

an air inlet into the separating chamber; and a shroud comprising a screen through which air is able to flow out of the separation chamber and a shroud skirt extending about one end of the shroud, the shroud skirt being fixed at a fixed edge and having a free edge, wherein the shroud skirt is formed of a deformable material and comprises a plurality of ribs formed on a surface of the shroud skirt facing the screen.

2. The dirt separator of claim 1, wherein the plurality of ribs are evenly spaced around a circumference of the shroud skirt.

3. The dirt separator of claim 1, wherein the ribs extend from the fixed edge and extend partially along the surface of the skirt towards the free edge.

4. The dirt separator of claim 3, wherein the ribs extend between 50% and 100% of a distance from the fixed edge to the free edge.

5. The dirt separator of claim 1, wherein the shroud skirt is pleated and each pleat is positioned between two consecutive ribs.

6. The dirt separator of claim 1, wherein in an unbiased position the shroud skirt is angled towards the outer wall and extends away from the longitudinal axis into the separating chamber.

7. The dirt separator of claim 1, wherein the ribs are formed as an increased thickness of shroud skirt material in localised areas.

8. The dirt separator of claim 1, wherein the dirt separator further comprises a wiper for wiping the shroud during a dirt emptying operation.

9. The dirt separator of claim 8, wherein the wiper contacts the screen and during the dirt emptying operation slides along a length of the screen in a longitudinal direction to push dirt towards an opening in the separating chamber.

10. The dirt separator of claim 9, wherein the outer wall of the separating chamber is slidable relative to the shroud, and the outer wall comprises the wiper which extends radially inwards from the outer wall.

11. The dirt separator of claim 10, wherein the outer wall is removable from the dirt separator, and during removal of the outer wall, the wiper slides over the shroud skirt while the shroud skirt is in a first deformed position in which the shroud skirt is collapsed towards the longitudinal axis of the separating chamber away from the screen.

12. The dirt separator of claim 11, wherein during reassembly of the outer wall onto the dirt separator, the wiper deforms the shroud skirt into a second deformed position in which the shroud skirt is collapsed in an opposite direction relative to the first deformed position and lies against the shroud screen.

13. The dirt separator of claim 8, wherein during the emptying operation, the wiper contacts the shroud skirt and deforms the shroud skirt into a first deformed position in which the shroud skirt is collapsed towards the longitudinal axis of the separating chamber away from the screen.

14. The dirt separator of claim 13, wherein on contacting the shroud skirt, the wiper first contacts the ribs on the shroud skirt which initiates a concertina deformation in the shroud skirt.

15. The dirt separator of claim 1, wherein the shroud skirt is formed of moulded rubber.

16. A dirt separator comprising:

a separating chamber defined by an outer wall, the separating chamber having a longitudinal axis;

an air inlet into the separating chamber; and a shroud comprising a screen through which air is able to flow out of the separation chamber and a shroud skirt extending about one end of the shroud, the shroud skirt being fixed at a fixed edge and having a free edge, wherein the shroud skirt is formed of a deformable material and comprises a plurality of ribs formed on a surface of the shroud skirt, and wherein the shroud skirt is deformable into a first deformed position in which the shroud skirt is collapsed towards the longitudinal axis of the separating chamber away from the screen.

17. The dirt separator of claim 16, wherein the free edge of the shroud skirt concertinas when in the first deformed position.

18. The dirt separator of claim 16, wherein the shroud skirt is deformable between the first deformed position and a second deformed position in which the shroud skirt is collapsed in an opposite direction relative to the first deformed position and lies against the shroud screen.

19. A vacuum cleaner comprising a dirt separator that comprises:

a separating chamber defined by an outer wall, the separating chamber having a longitudinal axis;

an air inlet into the separating chamber; and a shroud comprising a screen through which air is able to flow out of the separation chamber and a shroud skirt extending about one end of the shroud, the shroud skirt being fixed at a fixed edge and having a free edge, wherein the shroud skirt is formed of a deformable material and comprises a plurality of ribs formed on a surface of the shroud skirt facing the screen.

* * * * *